US005512990A

United States Patent [19]

Friel et al.

[11] Patent Number: 5,512,990

[45] Date of Patent: Apr. 30, 1996

[54] RESONATING ASSEMBLY HAVING A PLURALITY OF DISCRETE RESONATOR ELEMENTS

[75] Inventors: David M. Friel, Webster; Charles A. Radulski, Macedon; David B. Montfort, Penfield, all of N.Y.

[73] Assignee: Xerox Corporation, Stamford, Conn.

[21] Appl. No.: 365,377

[22] Filed: Dec. 27, 1994

[51] Int. Cl.[6] ..... G03G 15/14

[52] U.S. Cl. ..... 355/273; 310/321; 310/334

[58] Field of Search ..... 355/271, 273, 355/274; 228/1.1; 310/320–322, 325, 331, 334

[56] References Cited

U.S. PATENT DOCUMENTS

| | | | |
|---|---|---|---|
| 5,010,369 | 4/1991 | Nowak et al. | 355/273 |
| 5,016,055 | 5/1991 | Pietrowski et al. | 355/273 |
| 5,025,291 | 6/1991 | Nowak et al. | 355/273 |
| 5,057,182 | 10/1991 | Wuchinich | 228/1.1 X |
| 5,081,500 | 1/1992 | Snelling | 355/273 |
| 5,210,577 | 5/1993 | Nowak | 355/273 |
| 5,438,998 | 8/1995 | Hanafy | 310/334 X |

*Primary Examiner*—William J. Royer
*Attorney, Agent, or Firm*—Denis A. Robitaille

[57] ABSTRACT

A resonating assembly, generally for use in electrostatographic applications for enhancing transfer of toner from an image bearing member, with the resonating assembly positioned along a longitudinal axis generally transverse to the process direction of movement of the image bearing member, for applying uniform vibratory energy thereto. The resonating assembly includes a plurality of discrete individual resonator elements, each including a vibratory energy producing segment, such as a piezoelectric transducer, for generating vibratory energy and a waveguide segment coupled to the vibratory energy producing segment for directing the vibratory energy to the image bearing member. An alignment rod is provided for extending the length of the entire resonating assembly, along a longitudinal axis thereof, wherein the alignment rod facilitates critical alignment specifications for the resonating assembly. The alignment rod is cooperatively engaged with each discrete resonator element in a manner that permits each resonator element to function independent of each other.

27 Claims, 4 Drawing Sheets

RESONATING ASSEMBLY HAVING A PLURALITY OF DISCRETE RESONATOR ELEMENTS

The present invention relates generally to an apparatus for applying vibratory energy to an imaging surface to enhance toner transfer in an electrostatographic printing machine and, more particularly, relates to a resonating assembly including a plurality of independent resonator elements useful in applying vibratory energy to an imaging surface in electrostatographic applications.

In a typical electrophotographic printing process, a photoconductive member is initially charged to a substantially uniform potential and the charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy substrate such as a sheet of paper. Thereafter, heat or some other treatment is applied to the toner particles to permanently affix the powder image to the copy substrate. In a final step in the process, the photoconductive member is cleaned to remove any residual developing material on the photoconductive surface thereof in preparation for successive imaging cycles.

The electrophotographic printing process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

Typically, the process of transferring charged toner particles from an image bearing support surface, such as a photoreceptor, to a second support surface, such as a copy sheet or an intermediate transfer belt, is enabled by overcoming adhesion forces holding toner particles to the image bearing surface. In a conventional electrostatographic printing machine, transfer of toner images between support surfaces has been accomplished via electrostatic induction using a corona generating device, wherein the second supporting surface is placed in direct contact with the developed toner image on the image bearing surface while the back of the second supporting surface is sprayed with a corona discharge. The corona discharge generates ions having a polarity opposite that of the toner particles, thereby electrostatically attracting and transferring the toner particles from the image bearing surface to the second support surface. An exemplary corotron ion emission transfer system is disclosed in U.S. Pat. No. 2,836,725.

Thus, the process of transferring development materials to a copy sheet in an electrostatographic printing system involves the physical detachment and transfer-over of charged toner particles from an image bearing surface to a second surface through the utilization of electrostatic force fields. The critical aspect of the transfer process focuses on applying and maintaining high intensity electrostatic fields and/or other forces in the transfer region to overcome the adhesive forces acting on the toner particles. Careful control of these electrostatic fields and other forces is required in order to induce the physical detachment and transfer-over of the charged toner particles while maintaining the image configuration thereof without scattering or smearing of the developer material.

The use of vibratory energy has been disclosed, for example in U.S. Pat. No. 3,854,974 to Sato, et al., among other U.S. Patents, as a method for enhancing electrostatic toner release from an image bearing surface. More recently, systems incorporating a resonator, suitable for generating focused vibratory energy, arranged along the back side of the image bearing surface for applying uniform vibratory energy thereto, have been disclosed. In such systems, toner transfer is enhanced due to the mechanical release of the toner particles from the image bearing surface so that effective toner transfer can occur despite the fact that electrostatic charges in the transfer zone may be insufficient to attract toner from the image bearing surface to the second support surface. Exemplary systems of this nature are disclosed in U.S. Pat. No. 4,987,456 to Snelling et al.; U.S. Pat. No. 5,005,054 to Stokes et al.; U.S. Pat. No. 5,010,369 to Nowak et al.; U.S. Pat. No. 5,016,055 to Pietrowski et al.; U.S. Pat. No. 5,081,500 to Snelling et al.; and U.S. Pat. No. 5,210,577 to Nowak, among other U.S. Patents. The relevant teaching of the identified patents are incorporated by reference herein.

As disclosed in U.S. Pat. No. 4,987,456, a resonator suitable for generating focused vibratory energy generally includes a transducer element coupled to a resonating waveguide member having a contacting tip which is brought into tension or penetration contact with the image bearing belt for coupling the vibratory motion thereto. In systems which incorporate a resonator for applying uniform vibratory energy across the entire width of the photoreceptor, it has been shown that it may be desirable to provide widthwise slots along the length of the resonator waveguide member so as to segment the resonator into individually vibrating portions for providing increased velocity response across the waveguide member, as well as improvements to process width velocity uniformity. Such segmentation is disclosed in the previously cited U.S. patents, among others, where the waveguide member is cut perpendicularly to the plane of the image bearing surface, and generally parallel to the direction of travel of the image bearing surface to create an open-ended slot between each segment such that each segment acts more or less individually in response to the transducer.

Despite the positive results provided by segmentation of the resonator, stringent velocity uniformity requirements remain unattainable through segmentation alone. It appears that resonators having a length greater than approximately 0.5 inches exhibit a phenomenon known as "multipeak frequency response", wherein more than one resonant frequency in the narrow bandwidth at which the device would operate is exhibited for a given resonator structure. This phenomenon exacerbates the problem of nonuniform velocity along the tip of the resonator, and also dissipates the energy associated with the resonant condition. That is to say that the energy applied to the transducer for maximizing the tip velocity appears to be distributed among the numerous resonant conditions within the resonator such that frequency response amplitude predictability and repeatability become problematic. The present invention is directed toward providing a series of individual single peak frequency response resonators in a resonating assembly which would otherwise display multipeak frequency response characteristics in the narrow bandwidth at which the device would operate for generating a uniform velocity along the entire length of the assembly. The following disclosures may be relevant to various aspects of the present invention:

U.S. Pat. No. 5,010,369, Patentee: Nowak, et al., Issued: Apr. 23, 1991

U.S. Pat. No. 5,016,055, Patentee: Pietrowski, et al., Issued: May 14, 1991

U.S. Pat. No. 5,025,291, Patentee: Nowak et al., Issued: Jun. 18, 1991

U.S. Pat. No. 5,081,500, Patentee: Snelling, Issued: Jan. 14, 1992

U.S. Pat. No. 5,210,577, Patentee: Nowak, Issued: May 11, 1993

The relevant portions of the foregoing disclosures may be briefly summarized as follows:

U.S. Pat. No. 5,010,369 discloses a segmented resonator structure having a uniform response for electrophotographic imaging, wherein the resonator includes a waveguide member, a continuous support member, and a continuous vibration producing member that drives the waveguide member at a resonant frequency for applying vibratory energy to an image bearing belt surface. That patent discloses a waveguide member which includes a platform or base portion, a horn portion extending therefrom, and a contacting tip, wherein the horn is segmented through the contacting tip to the platform portion for forming a plurality of waveguide segments which each act more or less individually. Alternative embodiments are also disclosed, wherein the vibration producing member that drives the horn, and/or the support member may also be segmented in a manner corresponding to each waveguide segment.

U.S. Pat. No. 5,016,055 to Pietrowski et al. and U.S. Pat. No. 5,081,500 disclose a method and apparatus for using vibratory energy in combination with the application of a transfer field for enhanced transfer in electrophotographic imaging. An electrophotographic device, including a flexible belt-type transfer member or a sheet of paper is brought into intimate contact with a charge retentive member bearing a developed latent image at a transfer station for electrostatic transfer of toner from the charge retentive surface to the sheet. At the transfer station, a resonator suitable for generating vibratory energy is arranged in line contact with the back side of the charge retentive surface for uniformly applying vibratory energy to the charge retentive member such that toner will be released from the forces adhering it to the charge retentive surface at the line contact position by means of electrostatic and mechanical forces. In those areas characterized by non-intimate contact of the sheet with the charge retentive surface, toner is transferred across the gap by the combination of vibratory energy and the electrostatic transfer process, despite the fact that the charge on the paper would not normally be sufficient to attract toner to the sheet from the charge retentive surface.

U.S. Pat. No. 5,025,291 discloses an edge roll off effect compensation scheme for high frequency vibratory energy producing devices used in electrophotographic imaging, wherein a resonator including a waveguide member divided into a linear array of segments, and a corresponding array of vibration producing elements coupled to each horn segment, are each individually driven with a voltage to produce a high frequency vibratory response. The vibration producing elements coupled to the outer horn segments (along the marginal regions of the photoconductor) are driven with a higher voltage than those coupled to horn segments in the central portion of the array in order to avoid the problem of velocity response roll off which tends to occur at the outer segments of the array of waveguide segments.

U.S. Pat. No. 5,210,577 discloses another edge roll off effect compensation scheme for high frequency vibratory energy producing devices used in electrophotographic imaging, wherein a resonator including an energy transmitting waveguide member having a platform portion and a horn portion further includes a set of linearly arranged horn elements, with each horn element having a contacting portion, a voltage source, and a plurality of vibratory energy producing devices, each corresponding to a waveguide element for driving the horn elements to vibrate such that each vibratory energy producing device produces a vibration responsive to an applied voltage signal directed to each from the voltage source. In that patent, the plurality of vibratory energy producing devices specifically includes at least two groups, each group having a vibration response to the applied voltage signal directed thereto distinct from the other, for providing a substantially uniform vibration response to the applied voltage signal across the length of the resonator.

The present invention is directed toward a resonator for use in electrostatographic printing applications including a plurality of single peak frequency response resonator devices assembled into an extended resonating assembly for applying uniform vibratory energy to an image bearing surface.

In accordance with one aspect of the present invention, there is provided a resonating assembly for applying uniform vibratory energy to an adjacent surface, comprising a plurality of discrete resonator elements arranged along a substantially common plane, substantially parallel to the image bearing member.

In accordance with another aspect of the present invention, a system for enhancing transfer of toner from an image bearing member moving in a process direction is provided, including a resonating assembly adapted to contact the image bearing member for applying uniform vibratory energy thereto. The resonating assembly comprises a plurality of discrete resonator elements arranged along a substantially common plane, substantially parallel to the image bearing member.

In accordance with yet another aspect of the present invention, an electrostatographic printing apparatus having a system for enhancing transfer of toner from an image bearing member moving in a process direction is provided, including a resonating assembly adapted to contact the image bearing member, generally transverse to the process direction of movement thereof, for applying uniform vibratory energy thereto, comprising: a plurality of discrete resonator elements arranged along a substantially common plane, substantially parallel to the image bearing member; and an alignment rod extending along a longitudinal axis adapted for receiving each of said plurality of discrete resonator elements in a manner that permits each discrete resonator element to function independently.

These and other aspects of the present invention will become apparent from the following description in conjunction with the accompanying drawings, in which.

While the present invention will hereinafter be described in connection with a preferred embodiment and process, it will be understood that it is not intended to limit the invention to that embodiment or process. On the contrary, the following description is intended to cover all alternatives, modifications, and equivalents, as may be included within the spirit and scope of the invention as defined by the appended claims. Other aspects and features of the present invention will become apparent as the following description progresses.

Figure 5:
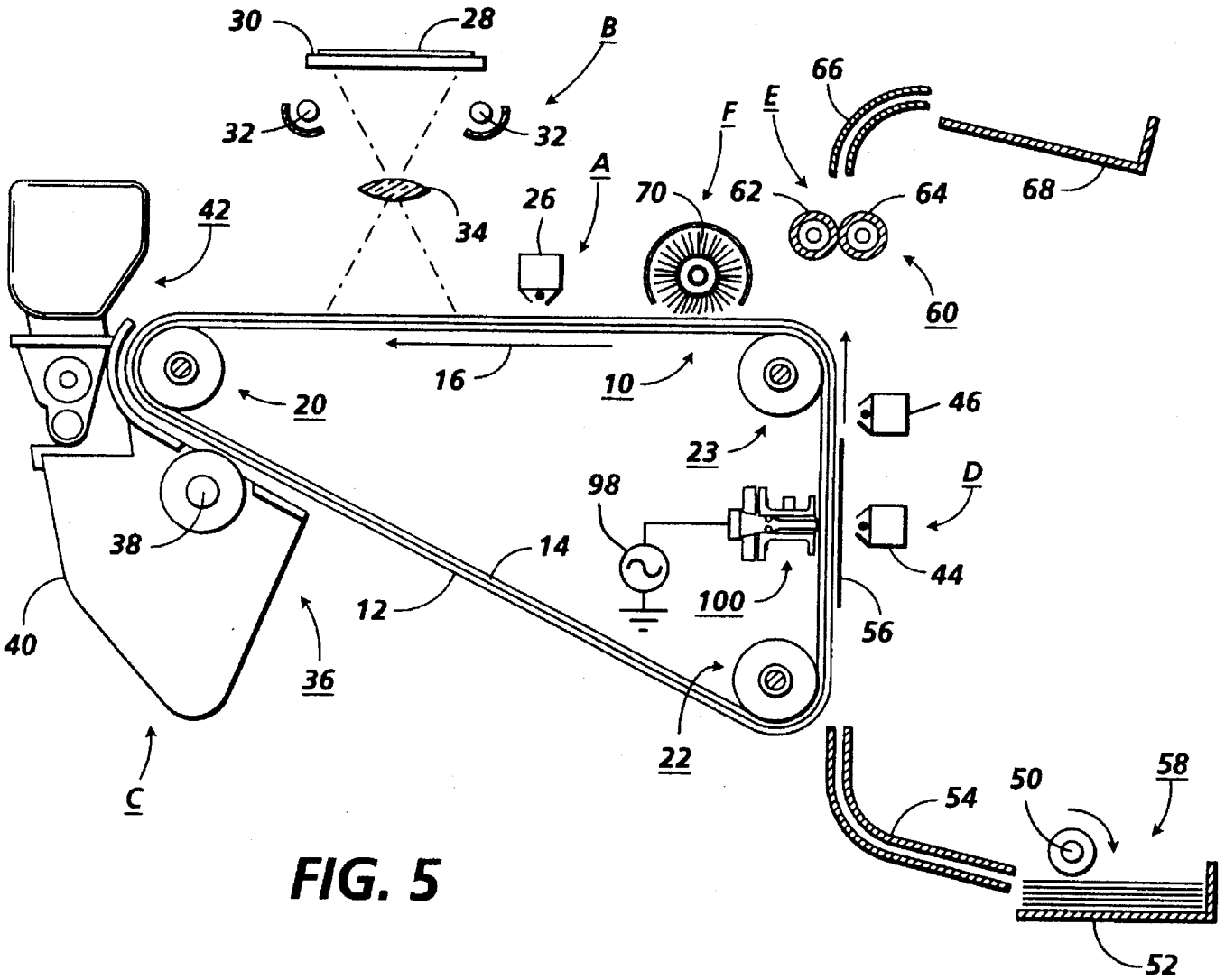
FIG. 5 is a schematic side view of an illustrative electrophotographic reproducing machine including an exemplary transfer station incorporating the resonator of the present invention.

For a general understanding of an exemplary printing machine incorporating the features of the present invention, a schematic depiction of the various processing stations, and the machine components thereof, is provided in FIG. 5. Although the resonator arrangement of the present invention is particularly well adapted for use with a transfer subsystem in an automatic electrophotographic reproducing machine as shown in FIG. 5, it will become apparent from the following discussion that the assembly of the present invention is equally well suited for use in a wide variety of electrostatographic processing machines as well as many other known printing systems. It will be further understood that the present invention is not necessarily limited in its application to a transfer subsystem and may also be useful in other subsystems in which particle adhesion/cohesion forces are desirably reduced, such as a development or cleaning subsystem, for example. It will be further appreciated that the present invention is not necessarily limited to the particular embodiment or embodiments shown and described herein.

Thus, prior to discussing the features and aspects of the present invention in detail, a schematic depiction of an exemplary electrophotographic reproducing machine incorporating various subsystems is furnished in FIG. 5, wherein an electrophotographic reproducing apparatus employs a belt 10, including a photoconductive surface 12 deposited on an electrically grounded conductive substrate 14. Drive roller 22 is coupled to a motor (not shown) by any suitable means, as for example a drive belt, and is further engaged with belt 10 for transporting belt 10 in a process direction of travel indicated by arrow 16. The process direction 16 is a curvilinear path defined by drive roller 22, and rotatably mounted tension rollers 20, 23. This system of rollers 20, 22, 23 is used for advancing successive portions of photoconductive surface 12 through various processing stations, disposed about the path of movement thereof, as will be described.

Initially, a segment of belt 10 passes through charging station A. At charging station A, a corona generating device or other charging apparatus, indicated generally by reference numeral 26, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from the light source are reflected from the original document 28 for transmission through a lens 34 to form a light image of the original document 28 which is focused onto the charged portion of photoconductive surface 12. The imaging process has the effect of selectively dissipating the charge on the photoconductive surface 12 in areas corresponding to non-image areas on the original document 28 for recording an electrostatic latent image of the original document 28 onto photoconductive surface 12. Although an optical imaging system has been shown and described herein for forming the light image of the information used to selectively discharge the charged photoconductive surface 12, one skilled in the art will appreciate that a properly modulated scanning beam of energy (e.g., a laser beam) or other means may be used to irradiate the charged portion of the photoconductive surface 12 for recording a latent image thereon.

After the electrostatic latent image is recorded on photoconductive surface 12, belt 10 advances to development station C where a magnetic brush development system, indicated generally by reference numeral 36, deposits particulate toner material onto the electrostatic latent image. Preferably, magnetic brush development system 36 includes a developer roll 38 disposed in a developer housing 40. Toner particles are mixed with carrier beads in the developer housing 40, generating an electrostatic charge which causes the toner particles to cling to the carrier beads, thereby forming the developing material. The magnetic developer roll 38 is rotated in the developer housing 40 to attract the developing material to form a "brush" comprising the developer roll 38 with carrier beads with toner particles magnetically attached thereto. As the developer roll 38 continues to rotate, the brush contacts belt 10 where developing material is brought into contact with the photoconductive surface 12 such that the latent image thereon attracts the toner particles from the developing material to develop the latent image into a visible image. A toner particle dispenser, indicated generally by reference numeral 42, is also provided for furnishing a supply of additional toner particles to housing 40 in order to sustain the developing process.

After the toner particles have been deposited onto the electrostatic latent image for creating a toner image thereof, belt 10 becomes an image bearing support surface and advances the developed image thereon to transfer station D. At transfer station D, a sheet of support material 56, such as paper or some other type of copy sheet or substrate, is moved into contact with the developed toner image on belt 10 via sheet feeding apparatus 58 and chute 54 for synchronously placing the support material 56 into contact with the developed toner image. Preferably, sheet feeding apparatus 58 includes a feed roller 50 which rotates while in frictional contact with the uppermost sheet of stack 52 for advancing sheets of support material 56 into chute 54, which guides the support material 56 into contact with photoconductive surface 12 of belt 10. The developed image on photoconductive surface 12 thereby contacts the advancing sheet of support material 56 in a precisely timed sequence for transfer thereto at transfer station D. A corona generating device 44 is also provided for charging the support material 56 to a potential so that the toner image is attracted from the surface 12 of photoreceptor belt 10 to the support material 56 while the support material 56 is also electrostatically tacked to photoreceptor belt 10.

With particular reference to the principle of enhanced toner release as provided by a vibratory energy assisted transfer system of the type to which the present invention is directed, the exemplary transfer station D of FIG. 5 includes a vibratory energy producing device or resonator 100 which may include a relatively high frequency acoustic or ultrasonic transducer driven by an AC voltage source 98. The resonator 100 is arranged in vibratory relationship with the back side of belt 10 at a position corresponding to the location of corona generating device 44 for applying vibratory energy to the belt 10 and for agitating the toner developed in imagewise configuration thereon to provide mechanical release of the toner particles from the surface of the belt 10. The vibratory energy enhances toner transfer by dissipating the attractive forces between the toner particles and the belt 10. In a preferred arrangement, the resonator 100 is configured such that the vibrating surface thereof is parallel to photoreceptor belt 10 and transverse to the direction of belt movement 16. The belt 10 has the characteristic of being nonrigid, or somewhat flexible, to the extent that it can be effected by the vibrating motion of the resonator 100, thereby providing mechanical release of the toner from the surface of belt 10 and allowing more efficient electrostatic attraction of the toner to a support material during the transfer step.

Vibratory assisted transfer, as provided by resonator 100, also provides increased transfer efficiency with lower than normal transfer fields. Such increased transfer efficiency not only yields better copy quality, but also results in improved toner use as well as a reduced load on the cleaning system. Exemplary vibratory transfer assist subsystems have been previously cited herein, and are incorporated in their entirety by reference into the present application for patent. Further details of vibratory assisted toner release in electrostatographic applications can also be found in an article entitled "Acoustically Assisted Xerographic Toner Transfer", by Crowley, et al., published by The Society for Imaging Science and Technology (IS&T) Final Program and Proceedings, 8th International Congress on Advances in Non-Impact Printing Technologies, October 25–30, 1992. The contents of that paper are also incorporated by reference herein.

Continuing with a description of the exemplary electrophotographic printing process, after the transfer step is completed, a corona generator 46 charges the support material 56 with an opposite polarity to release the support material from belt 10, whereupon the support material 56 is stripped from belt 10. The support material 56 is subsequently separated from the belt 10 and transported to a fusing station E. It will be understood by those of skill in the art, that the support material may also be an intermediate surface or member, which carries the toner image to a subsequent transfer station for transfer to a final support surface. These types of surfaces are also charge retentive in nature. Further, while belt type members are described herein, it will be recognized that other substantially nonrigid or compliant members may also be used with the invention.

Fusing station E includes a fuser assembly, indicated generally by the reference numeral 60, which preferably comprises a heated fuser roll 62 and a support roll 64 spaced relative to one another for receiving a sheet of support material 56 therebetween. The toner image is thereby forced into contact with the support material 56 between fuser roll 62 and 64 to permanently affix the toner image to support material 56. After fusing, chute 66 directs the advancing sheet of support material 56 to receiving tray 68 for subsequent removal of the finished copy by an operator.

Invariably, after the support material 56 is separated from belt 10, some residual developing material remains adhered to the photoconductive surface 12 thereof. Thus, a final processing station, namely cleaning station F, is provided for removing residual toner particles from photoconductive surface 12 subsequent to transfer of the toner image to the support material 56 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle. As previously noted, the cleaning station may also include a vibratory resonator arranged in a manner similar to resonator 100 for aiding in the removal of toner particles from belt 10.

The various machine functions described hereinabove are generally managed and regulated by a controller (not shown), preferably provided in the form of a programmable microprocessor. The microprocessor controller provides electrical command signals for operating all of the machine subsystems and printing operations described herein, including imaging onto the photoreceptor belt , paper delivery, xerographic processing functions associated with developing and transferring the developed image onto the paper, and various functions associated with copy sheet transport and subsequent finishing processes. As such, the controller initiates a sequencing schedule which is highly efficient in monitoring the status of a series of successive print jobs which are to be printed and finished in a consecutive fashion. Conventional sheet path sensors or switches are also utilized in conjunction with the controller for keeping track of the position of documents and the sheets in the machine. In addition, the controller regulates the various positions of gates and switching mechanisms, which may be utilized depending upon the system mode of operation selected. The controller may provide time delays, jam indications and fault actuation, among other things. The controller generally provides selectable option capabilities via a conventional user interface which allows operator input through a console or graphic user interface device (not shown) coupled to the controller.

The foregoing description should be sufficient for the purposes of the present disclosure to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

With particular reference to the principle of enhanced toner release as provided by the vibratory energy assisted transfer system described hereinabove, it is noted that, in order to achieve effective toner release and transfer utilizing such a system, the application of high frequency acoustic or ultrasonic energy to belt 10 should preferably take place within the area of application of the transfer field. It has been determined that transfer efficiency improvements effected by the vibratory energy assisted transfer system is a function, in part, of the frequency of the vibrational energy applied to the photoreceptor belt 10. Perhaps more importantly, it has also been determined that it is highly desirable to provide vibrational energy of a substantially uniform frequency along the process width of the belt, which is directly related to the uniformity of the frequency response of the resonator 100 along the length thereof. Nonuniform frequency response along the length of the resonator results in nonuniform transfer characteristics and may yield inconsistent output copies. It is also highly desirable to provide the resonator in the form of a unitary structure, for manufacturing and application requirements.

Figure 3:
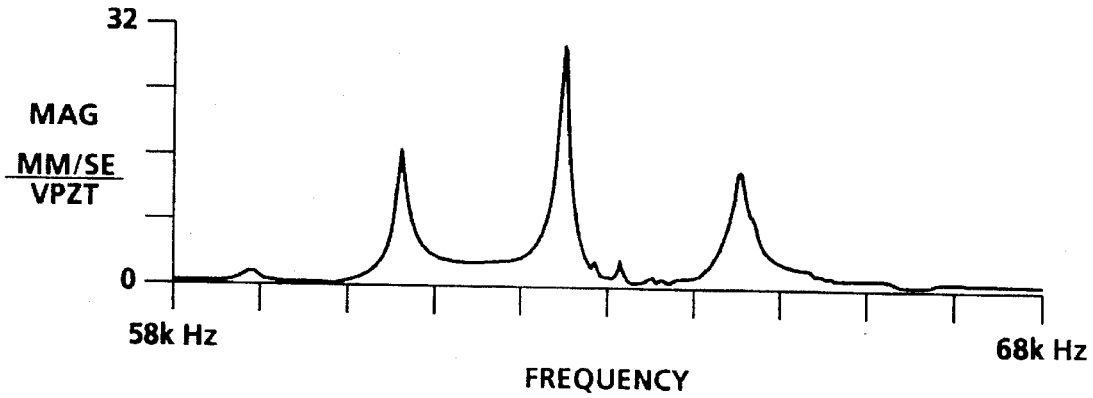
FIG. 3 is a graphic illustration showing the frequency response of a multipeak frequency response resonator device.
Figure 4:
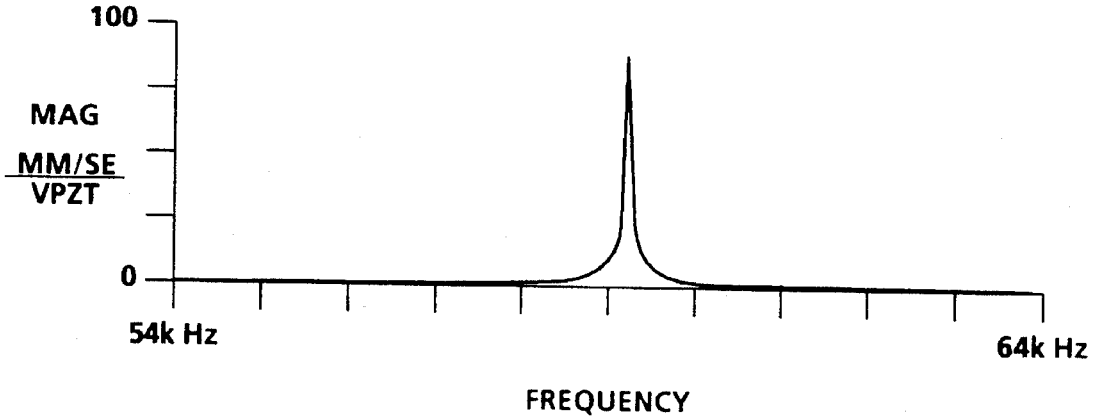
FIG. 4 is a graphic illustration showing the frequency response of a single peak frequency response resonator device.

It has previously been noted herein that resonators having a length greater than approximately 0.5 inches exhibit a phenomenon known as "multipeak frequency response", as graphically illustrated in FIG. 3, wherein more than one resonant frequency is exhibited in the bandwidth in which the device is intended to operate for a given resonator structure. This phenomenon exacerbates the problem of nonuniformity frequency response along the length of the resonator, and also tends to dissipate the energy associated with the resonant condition such that the energy applied to the transducer for maximizing the frequency response appears to be distributed among the numerous resonant conditions within the resonator. Thus, the amplitude of the response at a given resonant frequency for a resonator exhibiting multipeak frequency response in a given narrow bandwidth is difficult to predict and typically cannot be repeated for different resonators under identical operating conditions. The present invention provides a resonator including a plurality of single peak frequency response resonator devices which exhibit a constant and uniform frequency response in a predetermined operating bandwidth across the entire length thereof, as graphically illustrated in FIG. 4. In accordance with the present invention, a plurality of these single peak frequency response resonators are assembled into an extended resonating assembly for applying uniform vibratory energy across the entire process width of an image bearing surface.

Figure 1:
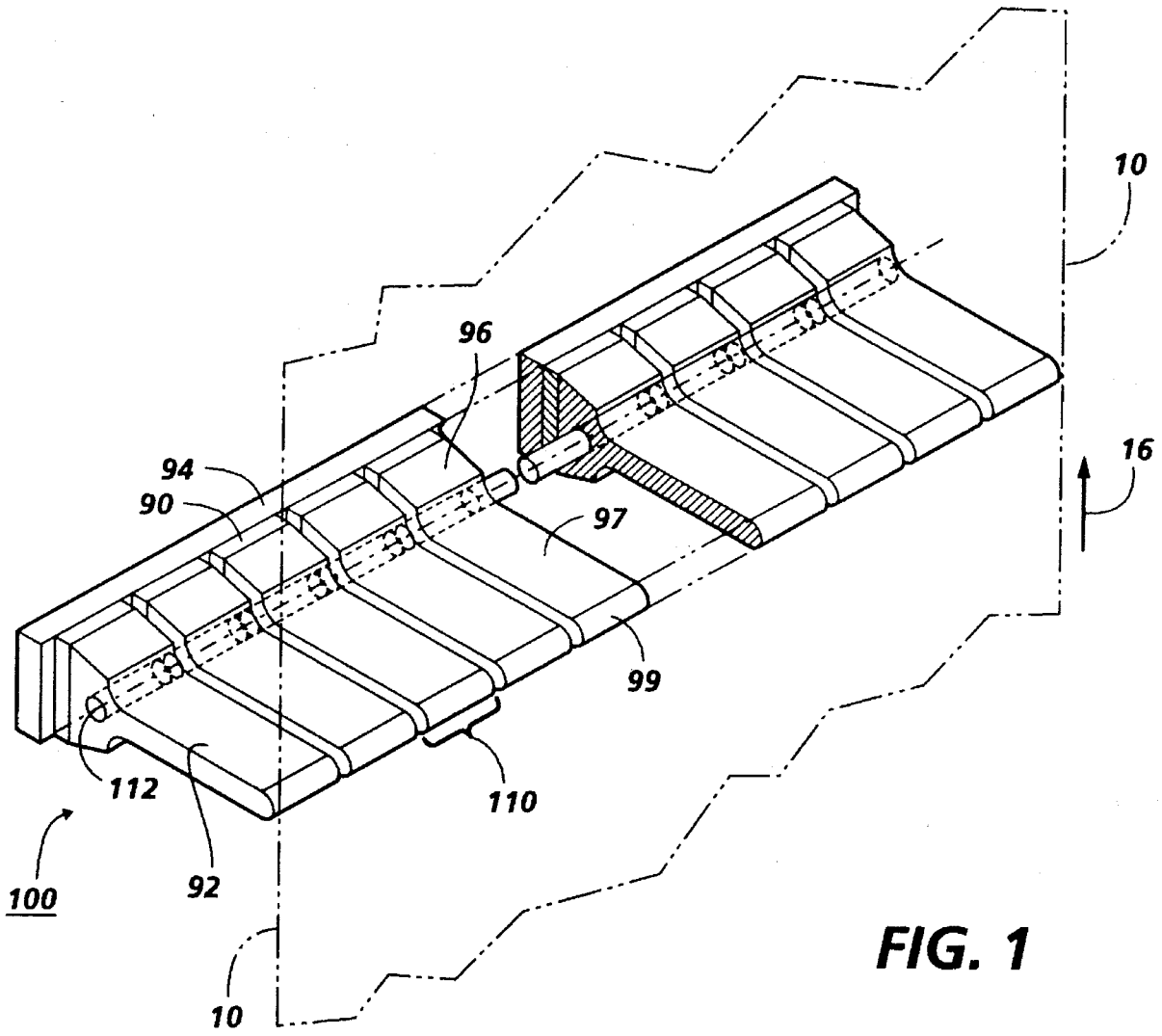
FIG. 1 is a partially broken away, perspective view of a resonating assembly in accordance with the present invention situated adjacent an image bearing photoconductive member.

With particular reference to FIG. 1, and as previously discussed, the principle of enhanced toner release as provided by the vibratory energy assisted transfer system described hereinabove is facilitated by a relatively high frequency acoustic or ultrasonic resonating assembly 100 which is preferably situated substantially in contact with the back side of belt 10, at a position in substantial alignment with the transfer corotron (not shown). The resonating assembly 100 includes a plurality of discrete single peak frequency response individual resonator elements 110 arranged along and mounted on a common backplane 94, fabricated from a semi-rigid material such as Lexan (a trademark of E. I. DuPont de Nemours Co.) or some other material. An alignment rod 112, which may be fabricated from steel or some other material, is also provided for providing additional structural integrity to the resonating assembly 100 by receiving each discrete resonator element 110 along a common longitudinal axis parallel to belt 10 and transverse to the process direction of movement thereof, generally indicated by arrow 16. The alignment rod 112 facilitates the cooperative engagement of each discrete resonator element to form a unitary structure in a manner that permits each resonator element 110 to function independently of one another with each discrete resonator element 110 is arranged with a vibrating surface along a substantially common plane parallel to belt 10 and transverse to the process direction of movement thereof, generally indicated by arrow 16. The structure described with respect to FIG. 1 provides an apparatus for producing vibratory energy which has been shown to repeatedly generate uniform frequency response along the entire length thereof.

Each individual resonator element 110, includes an individual vibratory energy producing segment 90, such as a piezoelectric transducer (driven by an A.C. voltage source) mounted to backplane 94, with the transducer segment having a corresponding waveguide segment 92, further coupled thereto. The vibratory energy producing segment 90 is generally operated at a frequency between 20 kHz and 200 kHz and typically at approximately 60 kHz. The waveguide segment 92 is preferably fabricated from aluminum, having a platform portion 96, a horn portion 97 and a contacting tip 99 for contacting belt 10, whereby the waveguide segment 92 operates to transmit the vibratory energy produced by the transducer 90 to the belt 10. An adhesive epoxy which may include a conductive mesh layer or other materials, as discussed, for example, in U.S. patent application Ser. No. 08/332,152, of common assignee, may be used to bond the transducer 90 to the backplane 94 and to the waveguide segment 92. It is noted that various shapes and structures have been considered for the waveguide segment 92, as discussed in U.S. Pat. No. 4,987,456. While a "stepped horn" type waveguide segment is shown, it will be understood that other shapes, such as an exponential shape, a conical shape, or the like may also be employed.

As previously discussed, it is highly desirable for the resonating assembly 100 to produce a uniform response along its length, for preventing image defects caused by nonuniform transfer characteristics. Although the embodiment shown and described with reference to FIG. 1 has been shown to be effective in providing a full length resonator having uniform frequency response across the length thereof, it has been found that the frequency response and the uniformity of the vibratory energy applied to the belt may vary due to a number of factors, including variations in the amplitude of response to the same or like input signals. Thus, in order to meet uniformity requirements one might measure the amplitude of response to a common input signal for each individual resonator element prior to inclusion into a given resonating assembly, whereby the given resonating assembly would be made up exclusively of resonator elements having the same or similar response amplitudes in a predetermined operating bandwidth.

Alternatively, discrete resonator elements can combined in a resonating assembly regardless of individual amplitude output or frequency response to provide a resonating assembly providing uniform vibratory energy to the belt by providing separate and independent voltage potentials to each discrete resonator element. This approach can be facilitated by providing a separately controllable voltage source coupled to the transducer 90 of each resonator element 110. In a preferred embodiment, contact leads coupled to each resonator element 110 can be connected to a circuit board comprising a series of variable resistors which may be remotely controlled through the system controller or some other software controlled microprocessor. Discrete resonator element output is adjusted and set through the controller to a predetermined value. Thus, in this alternative embodiment, each resonator element is individually provided with an input voltage in order to tailor frequency response and amplitude of each element. Preferably, the response and amplitude of each element is tailored to produce uniform vibratory energy across the process width of the belt such that nonuniform frequency response in each element may be compensated to produce a resonating assembly having a uniform frequency response across the length thereof.

One particular challenge to the uniformity of vibratory energy produced by a resonating assembly of the type described hereinabove, wherein a plurality of individual resonator elements 110 are mounted along a continuous backplane 94, is associated with alignment of the waveguide segment 92, particularly the alignment of the contacting tips 99 of each individual resonator element 110. In spite of best efforts to provide a resonating assembly having a substantially uniform frequency response along its length, the vibratory energy applied to the belt can be nonuniform as a result of improper alignment of each individual resonator contacting tip. Thus, the resonating assembly 100 of the present invention is provided with an alignment rod 112 extending the length of the entire resonating assembly 100, along a longitudinal axis thereof. In addition to facilitating critical alignment specifications, the alignment rod 112 minimizes undesirable cross process direction components of vibration by being cooperatively engaged with each individual resonator element 110 in a manner that permits each individual resonator element 110 to function independent of each other. Thus, each individual resonator element 110 is attached to the alignment rod 112 at a so-called nodal plane thereof, wherein the nodal plane defines an area in the waveguide segment at which minimal vibration takes place, such that the wave field through the waveguide segment 92 is essentially zero amplitude. In the illustrated embodiment of FIG. 1, the nodal plane is situated in the interface region between platform portion 96 and horn portion 97.

It will be understood that the alignment rod 112 is positioned in the nodal plane so as to provide structural integrity to the resonating assembly while effectively decoupling each discrete resonator element 110 from one another. This feature allows the frequency response of each resonator element 110 to remain unaffected by the resonant frequency of a neighboring element such that each resonator element operates substantially individually with no significant interaction between neighboring elements. The described arrangement produces an extended length resonating assembly having a frequency or velocity response along its length which tends toward uniformity across the contacting tip. It is also noted that the velocity response is greater across the plurality of individual element contacting tips 99. Thus, the described resonating assembly provides an excellent approach for preventing the previously described multipeak frequency response phenomenon by providing an effective structural configuration for assembling a plurality of single peak response resonator elements along a common axis or plane.

Figure 2:
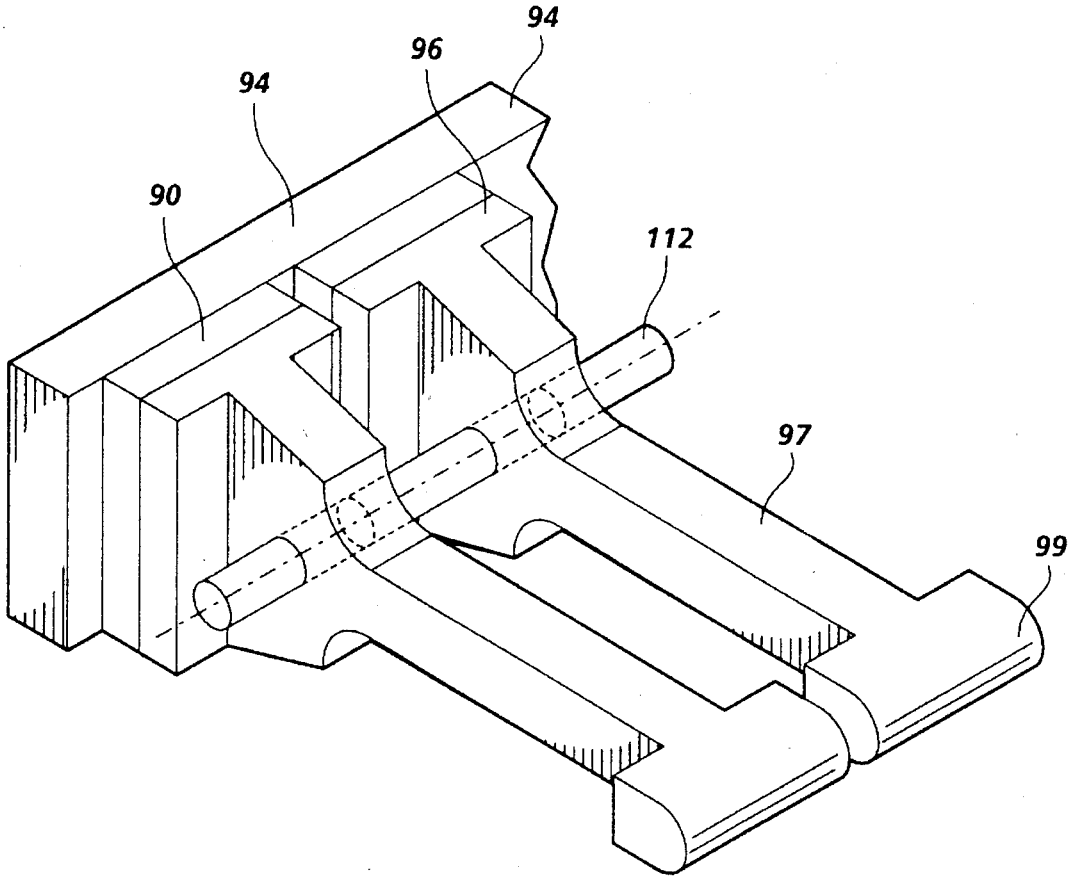
FIG. 2 is an enlarged perspective view of an alternative embodiment for a resonating assembly in accordance with the present invention.

Although the above described embodiment addresses the issue of alignment in a resonating assembly made up of a plurality of discrete individual resonator elements, some challenge remains with respect to the ability to align the resonator elements in this embodiment. Thus, an alternative embodiment of the present invention is shown in FIG. 2, wherein a significant alteration is made to the waveguide segment 92 for allowing access to the alignment rod 112 in the area between each resonator element 110. In this alternative embodiment, the waveguide segment 92 is provided with a region located along the platform portion 96 and the horn portion 97 which has a longitudinal dimension smaller than the contacting tip portion 99 for allowing access to the alignment rod 112. This waveguide segment geometry permits the use of mechanical location techniques to be applied to the alignment rod 112 due to the void created between neighboring resonator elements 110 adjacent to the alignment rod 112. By applying location forces directly to the alignment rod 112, alignment can be achieved without affecting individual performance characteristics of each resonator element 110. The geometry of the alternative embodiment shown in FIG. 2 has been shown to yield a satisfactory frequency response signal. However, it will be understood that numerous various design configurations may be contemplated wherein the following characteristics are of importance: uniform frequency response across the length of the resonator element; significant latitude in the location of the nodal plane; and ample space for access to the alignment rod.

It will be understood that, in order to provide a coupling arrangement for transmitting vibratory energy from the resonator 100 (FIG. 1) to the photoreceptor belt 10, the various resonator assembly embodiments described herein may be arranged in association with a vacuum arrangement as, for example, disclosed in U.S. Pat. No. 5,357,324 (incorporated by reference herein), wherein a vacuum plenum arrangement is advantageously utilized to urge belt 10 into positive contact with the resonating assembly 100 so that the waveguide segment 92 can effectively impart vibratory energy to belt 10. A coupling cover (not shown) may also be provided at the interface between the waveguide segment and the photoreceptor belt to create a replaceable protective coupling attachment for extending the functional life of the photoreceptor belt 10, as well as the resonating assembly 100, and, in particular, the waveguide segment 92 of each individual resonator element 110. A resonator coupling cover advantageously protects the resonator from wear and minimizes the effect of a torque spike occurring from contact with the seam of the photoreceptor belt 10 while enhancing toner release provided by the vibratory energy assisted transfer system by creating a damping effect which tends to eliminate image quality defects caused by migration of vibrational energy outside the transfer region. The particular features of the resonator coupling cover and horn waveguide, as well as various embodiments therefor, are discussed in detail in the various U.S. patents referenced herein.

With reference again to FIGS. 1–2, it will no doubt be appreciated that the inventive resonator arrangement may find application in various uses in electrophotographic applications as a means for improving uniformity of frequency response in an apparatus for providing vibratory energy to a flexible member for the release of toner therefrom for providing various uses in electrophotographic applications. One example of a use may be in causing release of toner from a toner bearing donor belt, arranged in development position with respect to a latent image. The resonator of the present invention has equal application in the cleaning station of an electrophotographic device with little variation. Accordingly, a resonating assembly in accordance with the present invention may be arranged in close relationship to the cleaning station F, for the mechanical release of toner from the surface prior to cleaning. Additionally, it will be understood by those of skill in the art that improvement in preclean treatment may occur with application of vibratory energy simultaneously with preclean charge leveling.

In review, the present invention generally describes a resonating assembly for use in electrostatographic applications. The resonating assembly is preferably incorporated into a toner transfer system for enhancing transfer of toner from an image bearing member moving in a process direction, with the resonating assembly positioned along a longitudinal axis generally transverse to the process direction of movement of the image bearing member, for applying uniform vibratory energy thereto. The resonating assembly comprises a plurality of discrete discrete resonator elements arranged along a substantially common plane, wherein each resonator element includes a vibratory energy producing element such as a transducer for generating the vibratory energy and a waveguide segment coupled to the vibratory energy producing element for directing the vibratory energy to the adjacent surface. An alignment rod is provided for extending the length of the entire resonating assembly 100, along a longitudinal axis thereof. In addition to facilitating critical alignment specifications, the alignment rod 112 is cooperatively engaged with each discrete resonator element 110 in a manner that permits each discrete resonator element 110 to function independent of each other.

It is, therefore, evident that there has been provided, in accordance with the present invention, a resonating assembly that fully satisfies the aims and advantages of the present invention as hereinbefore set forth. While this invention has been described in conjunction with a preferred embodiment and method therefor, it is evident that many alternatives, modifications, and variations will be apparent to those skilled in the art. Accordingly, it is intended to embrace all such alternatives, modifications and variations as fall within the spirit and broad scope of the appended claims.

We claim:

1. A resonating assembly for applying substantially uniform vibratory energy to an adjacent surface, comprising:

a plurality of discrete resonator elements arranged along a substantially common plane, substantially parallel to the adjacent surface;

a backplane member having said plurality of discrete resonator elements mounted thereon; and an alignment rod extending along a longitudinal axis adapted for receiving each of said plurality of discrete resonator elements in a manner that permits each discrete resonator element to function independently.

2. The resonating assembly of claim 1, wherein each of said plurality of discrete resonator elements provides a substantially single peak frequency response characteristic in a predetermined operating bandwidth.

3. The resonating assembly of claim 2, wherein each of said plurality of discrete resonator elements provides a substantially similar response amplitude in the predetermined operating bandwidth.

4. The resonating assembly of claim 1, wherein each of said plurality of discrete resonator elements includes:

a vibratory energy producing segment for generating vibratory energy; and a waveguide segment coupled to said vibratory energy producing segment for transmitting the vibratory energy from said vibratory energy producing segment to the adjacent surface.

5. The resonating assembly of claim 4, wherein said waveguide segment includes a nodal plane defining an area in said waveguide segment whereat vibratory energy transmitted therethrough is minimal.

6. The resonating assembly of claim 4, wherein said waveguide segment includes:

a contacting tip portion for contacting the adjacent surface; and a platform portion for being positioned in contact with said vibratory energy producing segment; and a horn portion interposed between said contacting tip portion and said platform portion.

7. The resonating assembly of claim 6, wherein:

said contacting tip portion is defined by a first longitudinal dimension; and said platform portion and said horn portion include a second longitudinal dimension smaller than the first longitudinal dimension for defining a void between each of said discrete resonator elements so as to permit access to said alignment rod.

8. The resonating assembly of claim 3, further including a controllable voltage source coupled to each of said plurality of discrete resonator elements for providing an individual input signal to each of said plurality of discrete resonator elements to tailor the vibratory energy output of the resonating assembly.

9. A system for enhancing release of toner from an image bearing member moving in a process direction, including a resonating assembly for applying uniform vibratory energy to the image bearing member, comprising:

a plurality of discrete resonator elements arranged along a substantially common plane, substantially parallel to the image bearing member.

10. The system of claim 9, further including a backplane member having said plurality of discrete resonator elements mounted thereon.

11. The system of claim 9, further including an alignment rod extending along a longitudinal axis adapted for receiving each of said plurality of discrete resonator elements in a manner that permits each discrete resonator element to function independently.

12. The system of claim 11, wherein each of said plurality of discrete resonator elements includes:

a vibratory energy producing segment for generating vibratory energy; and a waveguide segment coupled to said vibratory energy producing segment for transmitting the vibratory energy from said vibratory energy producing segment to the image bearing member.

13. The system of claim 12, wherein said waveguide segment includes a nodal plane defining an area in said waveguide segment whereat vibratory energy transmitted therethrough is minimal.

14. The system of claim 12, wherein said waveguide segment includes:

a contacting tip portion for contacting the image bearing member; and a platform portion for being positioned in contact with said vibratory energy producing segment; and a horn portion interposed between said contacting tip portion and said platform portion.

15. The system of claim 14, wherein:

said contacting tip is defined by a first longitudinal dimension; and said platform portion and said horn portion include a second longitudinal dimension smaller than the first longitudinal dimension for defining a void between each of said discrete resonator elements so as to permit access to said alignment rod.

16. The system of claim 9, wherein each of said plurality of discrete resonator elements provides a substantially single peak frequency response characteristic in a predetermined operating bandwidth.

17. The system of claim 16, wherein each of said plurality of discrete resonator elements provides a substantially similar response amplitude in the predetermined operating bandwidth.

18. The system of claim 9, further including a controllable voltage source coupled to each of said plurality of discrete resonator elements for providing an individual input signal to each of said plurality of discrete resonator elements to tailor the vibratory energy output of the resonating assembly.

19. The system of claim 9, further including means for electrostatically attracting the toner from the image bearing member.

20. The system of claim 19, wherein said resonating assembly and said electrostatic attracting means are in substantial alignment with one another.

21. An electrostatographic printing apparatus having a system for enhancing transfer of toner from an image bearing member moving in a process direction including a resonating assembly adapted to contact the image bearing member, generally transverse to the process direction of movement thereof, for applying uniform vibratory energy thereto, comprising:

a plurality of discrete resonator elements arranged along a substantially common plane, substantially parallel to the image bearing member; and an alignment rod extending along a longitudinal axis adapted for receiving each of said plurality of discrete resonator elements in a manner that permits each discrete resonator element to function independently.

22. The electrostatographic printing apparatus of claim 21, wherein each of said plurality of discrete resonator elements provides a substantially single peak frequency response characteristic in a predetermined operating bandwidth.

23. The electrostatographic printing apparatus of claim 21, wherein each of said plurality of discrete resonator elements provides a substantially similar response amplitude in the predetermined operating bandwidth.

24. The electrostatographic printing apparatus of claim 21, wherein each of said plurality of discrete resonator elements includes:

a vibratory energy producing segment for generating vibratory energy; and a waveguide segment coupled to said vibratory energy producing segment for transmitting the vibratory energy from said vibratory energy producing segment to the image bearing member, said waveguide segment including a nodal plane defining an area in said waveguide segment whereat vibratory energy transmitted therethrough is minimal.

25. The electrostatographic printing apparatus of claim 24, wherein said waveguide segment includes:

a contact portion for contacting the image bearing member, said contact portion being defined by a first longitudinal dimension; and a platform portion for being positioned in contact with said vibratory energy producing segment; and a horn portion interposed between said contact portion and said platform portion, said platform portion and said horn portion including a second longitudinal dimension smaller than the first longitudinal dimension for defining a void between each of said discrete resonator elements so as to permit access to said alignment rod.

26. The electrostatographic printing apparatus of claim 21, further including a controllable voltage source coupled to each of said plurality of discrete resonator elements for providing an individual input signal to each each of said plurality of discrete resonator elements to tailor the vibratory energy output of the resonating assembly.

27. The electrostatographic printing apparatus of claim 21, further including means for electrostatically attracting the toner from the image bearing member, wherein said resonating assembly and said electrostatic attracting means are in substantial alignment with one another.

* * * * *